US011280216B2

(12) United States Patent
Domnick

(10) Patent No.: US 11,280,216 B2
(45) Date of Patent: Mar. 22, 2022

(54) DEVICE FOR COOLING A COMPONENT OF A GAS TURBINE/TURBO MACHINE BY MEANS OF IMPINGEMENT COOLING

(71) Applicant: MAN Energy Solutions SE, Augsburg (DE)

(72) Inventor: Clemens Bernhard Domnick, Hünxe (DE)

(73) Assignee: MAN Energy Solutions SE, Augsburg (DE)

( * ) Notice: Subject to any disclaimer, the term of this patent is extended or adjusted under 35 U.S.C. 154(b) by 0 days.

(21) Appl. No.: 17/089,714

(22) Filed: Nov. 4, 2020

(65) Prior Publication Data

US 2021/0131292 A1 May 6, 2021

(30) Foreign Application Priority Data

Nov. 6, 2019 (DE) ..... 10 2019 129 835.0

(51) Int. Cl.
*F01D 25/12* (2006.01)
*F01D 5/18* (2006.01)
*F01D 25/08* (2006.01)

(52) U.S. Cl.
CPC ..... *F01D 25/12* (2013.01); *F01D 5/187* (2013.01); *F01D 25/08* (2013.01);
(Continued)

(58) Field of Classification Search
CPC ..... F05D 2260/2214; F05D 2260/221; F05D 2260/22141; F05D 2260/2212;
(Continued)

(56) References Cited

U.S. PATENT DOCUMENTS 10,370,983 B2 * 8/2019 Weaver ..... F01D 9/041
10,408,064 B2 * 9/2019 Zuniga ..... F28F 13/12
(Continued)

FOREIGN PATENT DOCUMENTS

CN 103075202 5/2013
DE 10 2008 003 412 7/2008
(Continued)

OTHER PUBLICATIONS

Search Report dated Mar. 3, 2021 issued in European Patent Application No. 20203280.1.
(Continued)

*Primary Examiner* — Eldon T Brockman
(74) *Attorney, Agent, or Firm* — Cozen O'Connor

(57) ABSTRACT

A device for cooling a component to be cooled of a gas turbine/turbo machine having a hot-gas-impinged outer surface, a target surface of the component, and an integrated cooling passage, includes: an impingement cooling element arranged within the cooling passage, the impingement cooling element having plural impingement cooling bores; and a surface structure arranged on the target surface. The impingement cooling element is spaced apart from the target surface of the component and configured so as to conduct a cooling fluid as an impingement cooling jet is onto the target surface, such that the impingement cooling jet impinges on the surface structure.

5 Claims, 3 Drawing Sheets

(52) U.S. Cl.
CPC .... *F05B 2240/33* (2013.01); *F05D 2260/201* (2013.01); *F05D 2260/221* (2013.01); *F05D 2260/2212* (2013.01); *F05D 2260/2214* (2013.01); *F05D 2260/22141* (2013.01)

(58) Field of Classification Search
CPC .. F23R 2900/03043; F23R 2900/03045; F01D 5/187
See application file for complete search history.

(56) References Cited

U.S. PATENT DOCUMENTS

| | | | | |
|---|---|---|---|---|
| 10,830,095 | B2 * | 11/2020 | Akturk | F01D 25/12 |
| 2017/0167381 | A1 * | 6/2017 | Duelm | F02C 7/12 |
| 2017/0191417 | A1 | 7/2017 | Bunker et al. | |
| 2018/0258773 | A1 * | 9/2018 | Zuniga | F01D 25/12 |
| 2019/0032495 | A1 * | 1/2019 | Weaver | F01D 25/12 |
| 2019/0249566 | A1 * | 8/2019 | Akturk | F23R 3/002 |

FOREIGN PATENT DOCUMENTS

| | | | | |
|---|---|---|---|---|
| EP | 0905353 | | 3/1999 | |
| EP | 1 001 135 | | 5/2000 | |
| EP | 2902589 | A1 * | 8/2015 | F01D 5/188 |
| EP | 2918780 | | 9/2015 | |
| JP | 2013-019348 | | 1/2013 | |

OTHER PUBLICATIONS

Office Action dated Jul. 9, 2020 issued in German Patent Application No. 10 2019 129 835.0.

* cited by examiner

DEVICE FOR COOLING A COMPONENT OF A GAS TURBINE/TURBO MACHINE BY MEANS OF IMPINGEMENT COOLING

BACKGROUND OF THE INVENTION

1. Field of the Invention

The invention relates to a device for cooling a component of a gas turbine/turbo machine.

2. Description of the Related Art

A multiplicity of components, such as for example the blades, of a gas turbine is exposed to the high temperatures of the combustion gases of the combustion chamber. Furthermore, the efficiency of gas turbines can be further improved by increasing the combustion temperatures achieved in the combustion chamber. However, such a temperature increase has limits because of the thermal capacity of the components exposed to the hot gases. This applies in particular to the guide and moving blades of the turbine stage downstream of the combustion chamber that are also subjected to major mechanical stress.

For this reason, particular cooling methods are required in order to counteract a component failure and not exceed the material-based temperature limits. The relevant components and in particular the regions of the components that are subjected to high thermal loads are cooled with cooling air branched off the compressor in the known manner. In the prior art, the leaves of these blades are equipped with cooling devices that are fed with cooling air. The blade cooling is achieved by extracting a part of the compressed air from the compressor and passing this air on to the turbine portion. Following its introduction into the turbine portion, this cooling air flows through passages formed in the blade leaf portions of the blades.

DE 10 2008 003 412 A1 discloses more effectively cooling the blade tip capping by a localized, directed impingement cooling in order to reduce the metal temperature in regions of the tip capping subjected to major stress.

Apart from this, separating walls, for example in an impingement cooling for a turbine blade known from EP 1 001 135 A2, running in the longitudinal direction are arranged, for example, in the interior of a hollow blade delimited by two side walls, which in each case form, with a side wall portion, an elongated cooling air supply and cooling air distribution chamber as well as multiple impingement air cooling chambers adjoining these. By way of the impingement air passages, the cooling air introduced into the cooling air chamber reaches the adjacent impingement air cooling chambers to thereby cool the inner surfaces of the regions of the outer walls of the turbine blades subjected to high thermal stress from the inside and thus be able to operate the gas turbine with preferably high combustion temperatures with high efficiency and without material damage. In the separating wall, the impingement air passages are orientated linearly but obliquely to ensure a favorable angle for the impingement cooling air impinging on the inner surfaces of the outer walls. The air exiting from the impingement air cooling chambers via air passages in the side walls of the turbine blade additionally creates an insulation layer between the blade material and the hot gas, which further reduces the thermal stress on the turbine blade.

SUMMARY OF THE INVENTION

An object of the present invention is to provide a device for cooling a component of a gas turbine/turbo machine which further improves the efficiency of the cooling.

According to one aspect of the invention, a device for cooling a component of a gas turbine/turbo machine with a hot-gas-impinged outer surface and an integrated cooling passage is provided. Within the cooling passage, an impingement cooling element with at least one impingement cooling bore is arranged. This impingement cooling element is spaced apart from a target surface of the component to be cooled and for cooling the component a cooling fluid as an impingement cooling jet is conductible through the impingement cooling bore onto the target surface. Furthermore, a surface structure, which the impingement cooling jet strikes, is formed on the target surface.

This is advantageous in that the microstructure of the target surfaces by the suitably formed surface structure improves heat transfer. In this manner, the consumption of the cooling medium can be reduced with the cooling effect remaining the same or the cooling performance improved with the consumption of the cooling medium remaining the same. Consequently, the invention saves cooling air and thus serves the primary objective of increasing efficiency.

In an advantageous embodiment it is provided that the surface structure is formed by stellate ribs, which protrude from the target surface. The microstructure of the target surface according to an aspect of the invention comprises ribs arranged radially to the impingement cooling jet. By way of these suitably formed ribs, multiple physical effects are utilized, which increase the heat transfer. Initially, the surface area of the target surface is increased in this way and the heat flow density increased through a local acceleration of the flow because of the corresponding arrangement of the ribs. In addition to this, the cooling air flow of transverse flows that are harmful to the heat transfer is shielded and a flow separation avoided.

In a further advantageous version it is provided according to an aspect of the invention that the surface structure is formed by stellate ribs each alternating in a different form, which ribs protrude from the target surface. In certain application cases, ribs arranged in multiple rows on the target surface can further improve the flow characteristic and thus also the cooling performance, since the surface structure can be optimally adapted to the geometry of the component to be cooled.

Preferentially, the device for cooling the component is formed such that the ribs of the surface structure, spaced apart from a central point located opposite the impingement cooling bore, run radially to the outside. This is advantageous for the cooling performance of the impingement cooling jet since the cooling jet, directly after impinging on the target surface, is thus conducted past the surface structure or the ribs.

In an exemplary embodiment of the invention it is provided that the ribs have a drop-shape, which tapers towards the outside. Because of the specially formed geometry, the flow characteristics or the cooling performance of the cooling air flow are optimized.

Furthermore an embodiment is favorable in which the ribs have a linear, rod-like shape. Especially with a surface structure formed in multiple rows, alternating geometries of the ribs are favorable for an optimal cooling performance of the cooling air flow.

The device for cooling a component of a gas turbine/turbo machine according to an aspect of the invention is formed in an embodiment version so that the ribs have a different length and/or height with which the ribs extend on the target surface. This in turn has a positive effect on the flow of the cooling air, as a result of which the efficiency is increased.

It is advantageous, furthermore, when stellate ribs are formed on the target surface in a row opposite a corresponding row of impingement cooling bores. In this manner, a special surface structure with suitable ribs is arranged on the target surfaces in each region in which the cooling air flow passes through the impingement cooling bore and impinges on the target surface. As a consequence, the cooling performance of the component of the gas turbine/turbo machine is increased on each of these regions.

In an alternative embodiment of the present device it is provided, furthermore, that the distance of the start of each rib located radially inside to the central point corresponds to approximately 75%-150% of the length of the rib. Here it is favorable that the cooling air flow initially impinges the cooling surface and subsequently flows past the relevant ribs for optimizing the cooling performance.

In a preferred embodiment of the invention, the side flanks of the ribs run orthogonally at least at the juncture to the target surface and are preferentially formed obliquely or rounded only at the transition to a shroud side. In a further advantageous embodiment it is provided according to an aspect of the invention that the shroud side is formed flat and parallel to the target surface. In this manner, the surface of the ribs is maximized and the surface structure of the target surface has an optimal or maximum surface area for cooling.

Furthermore, a gas turbine/turbo machine having a device for cooling a component of the gas turbine/turbo machine described above is proposed according to an aspect of the invention.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Other advantageous further developments of the invention are shown in more detail in the following by way of the figures or together with the description of the preferred embodiment of the invention. In the drawings.

DETAILED DESCRIPTION OF THE PRESENTLY PREFERRED EMBODIMENTS

Figure 1:
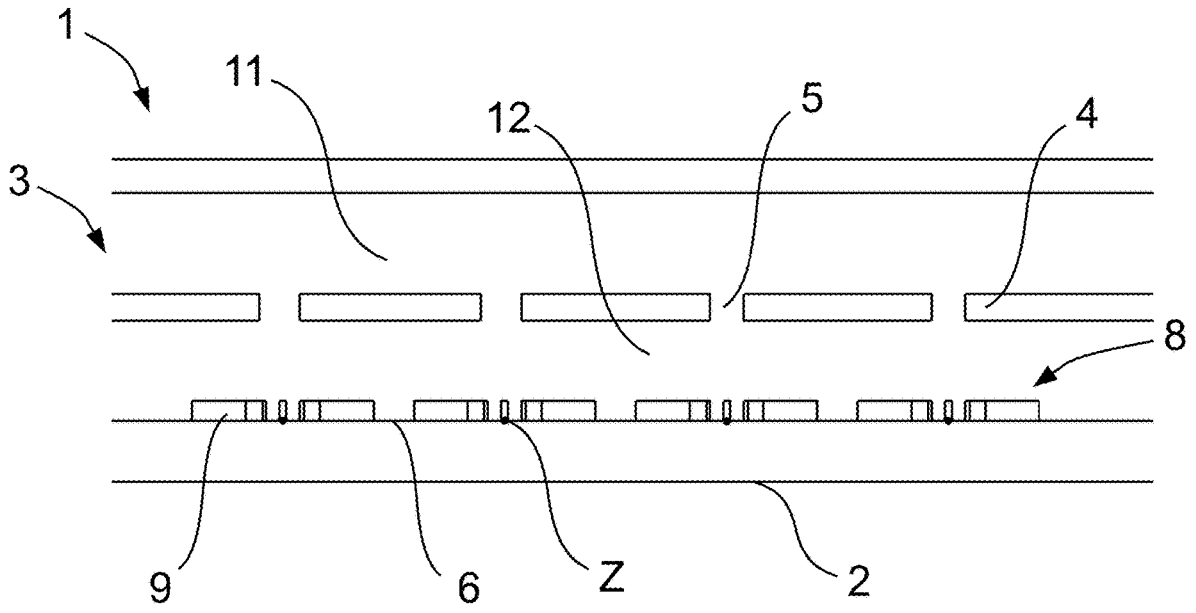
FIG. 1 is a sectional view of a gas turbine component with a surface structure on the target surface of the impingement cooling.

FIG. 1 is a sectional view of a gas turbine component 1 having a device for impingement cooling, which comprises a surface structure 8 on the target surface 6 of the impingement cooling arrangement.

The gas turbine component 1 comprises an outer surface 2 that is impinged by hot gas during operation and an integrated cooling passage 3 for cooling. An impingement cooling element 4, which divides the cooling passage 3 into a supply part 11 for coolant supply and a cooling part 12, in which the target surface 6 to be cooled is arranged, runs within the cooling passage 3. The impingement cooling element 4 is spaced apart from the target surface 6 to be cooled in the cooling part 12 of the component 1. Furthermore, the impingement cooling element 4 comprises four impingement cooling bores 5 in the shown region, via which a cooling fluid is conductible as an impingement cooling jet for cooling the component 1 onto a central point Z of the target surface 6 located opposite the impingement cooling bore 5.

Figure 2:
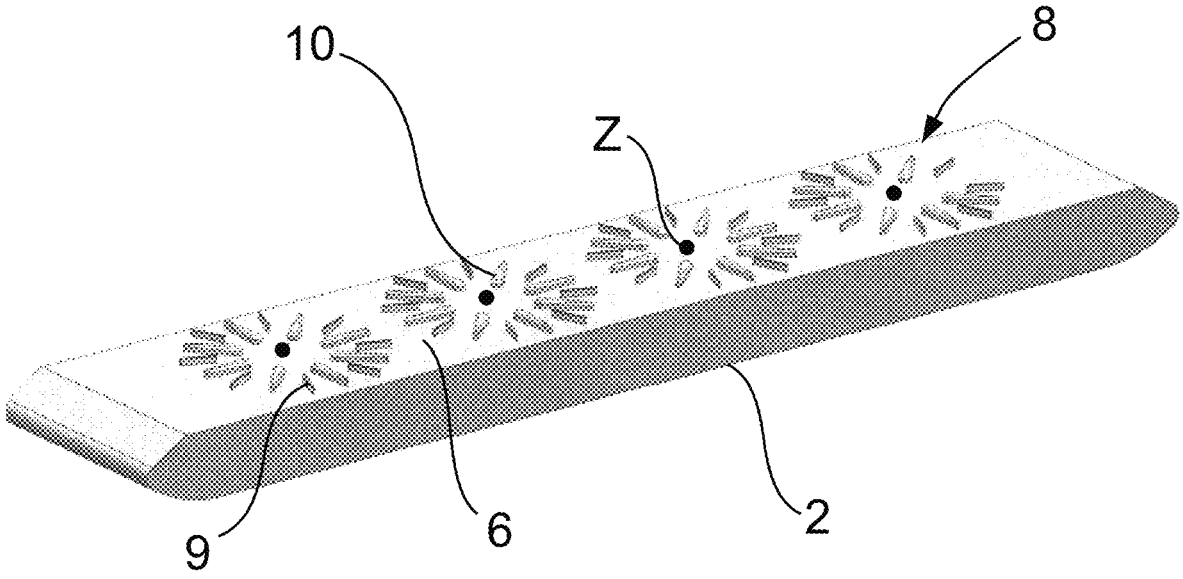
FIG. 2 is a perspective view of a target surface with ribs arranged in one row, and FIG. 3 a perspective view of a target surface with ribs arranged in multiple rows.

A perspective view of a target surface 6 with ribs 9 arranged in multiple rows is shown in FIG. 2. The surface structure 8 corresponds to the representation shown in FIG. 1 and described in the following.

The surface structure 8, which the impingement cooling jet impinges on, is formed on the target surface 6. This surface structure 8 is formed by stellate ribs 9 each alternating in a different form, which protrude from the target surface 6. Spaced apart from the central point Z located opposite the impingement cooling bore 5, the ribs 9 run radially to the outside. The radial arrangement out of the ribs 9 on the target surface 6 are formed and arranged in a row opposite a corresponding row of impingement cooling bores 5. The side flanks of the ribs 9 run orthogonally at the juncture to the target surface 6 and are formed obliquely and rounded only at the transition towards a shroud side 10. Apart from this, the respective alternating ribs 9 have a different length and height with which the ribs extend on the target surface 6. One of the two radial arrangements comprises drop-shaped ribs 9 which taper towards the outside, and the distance of the start of each rib 9 located radially inside to the central point Z approximately corresponds to 75% of the length of this rib 9. By contrast, the ribs 9 of the other radial arrangement have a linear, rod-shaped form and the distance of the start of each rib 9 located radially inside to the central point Z corresponds approximately to 150% of the length of this rib 9. The shroud side 10 of the ribs 9 is formed flat and parallel to the target surface 6.

Figure 3:
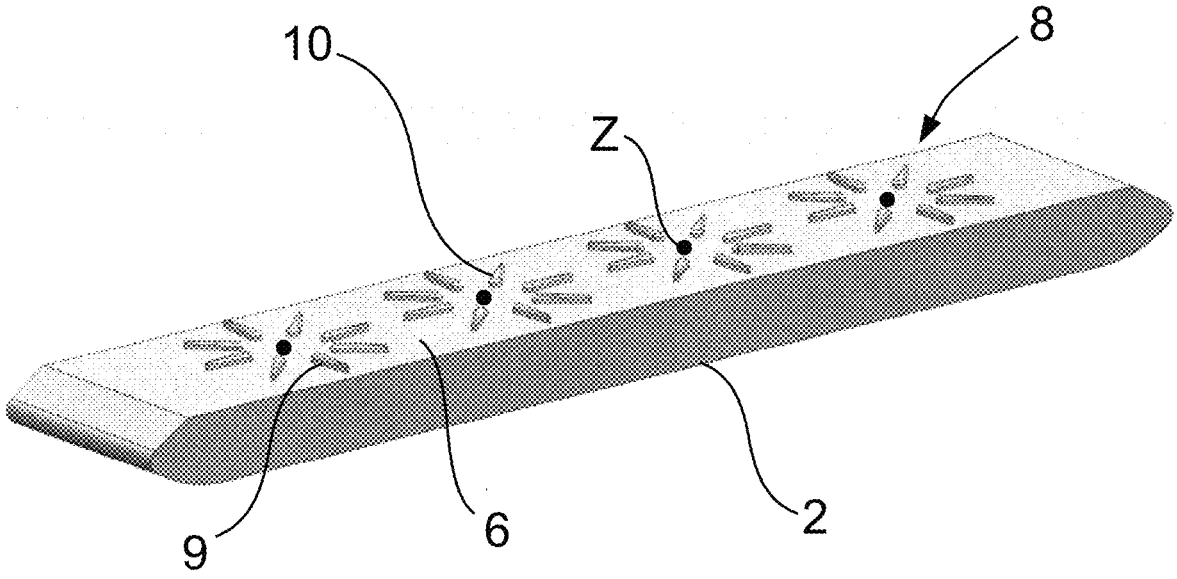

FIG. 3 shows a perspective view of a target surface 6 with ribs 9 arranged in one row. The surface structure 8 is formed by the drop-shaped stellate ribs 9 as described before, which protrude from the target surface 6.

LIST OF REFERENCE NUMBERS

1 Gas turbine component
2 Outer surface
3 Cooling passage
4 Impingement cooling element
5 Impingement cooling bore
6 Target surface
8 Surface structure
9 Ribs
10 Shroud side
11 Supply part
12 Cooling part
Z Central point Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A device for cooling a component (1) to be cooled of a gas turbine/turbo machine having a hot-gas-impinged outer surface (2), a target surface (6) of the component (1), and an integrated cooling passage (3), comprising:

an impingement cooling element (4) arranged within the cooling passage (3), the impingement cooling element (4) having plural impingement cooling bores (5); and a surface structure (8) arranged on the target surface (6), the surface structure (8) comprising stellate ribs (9), which ribs protrude from the target surface (6), the stellate ribs (9) run, spaced apart from a central point (Z) located opposite a respective impingement cooling bore (5), radially to the outside, the stellate ribs (9) together forming first and second radial arrangements, the first radial arrangement consisting of drop-shaped ribs, whose shape tapers radially towards the outside, and the second radial arrangement consisting of linear, rod-shaped ribs, the drop-shaped ribs and the linear, rod-shaped ribs being arranged in alternating fashion, wherein the distance from the radially innermost tip of each drop-shaped rib to the central point (Z) corresponds to approximately 75% of the length of the drop-shaped rib, and wherein the distance from the radially innermost tip of each linear, rod-shaped rib to the central point (Z) corresponds to approximately 150% of the length of the linear, rod-shaped rib, and wherein the impingement cooling element (4) is spaced apart from the target surface (6) of the component (1) and configured so as to conduct a cooling fluid as an impingement cooling jet onto the target surface (6), such that the impingement cooling jet impinges on the surface structure (8).

2. The device according to claim 1, wherein star-like arrangements out of the ribs (9) are arranged on the target surface (6) in a row opposite a corresponding row of the impingement cooling bores (5).

3. The device according to claim 1, wherein side flanks of the ribs (9) run orthogonally at least at a connection to the target surface (6) and are arranged obliquely or rounded only at a transition to a shroud side (10).

4. The device for cooling a component (1) of a gas turbine/turbo machine according to claim 3, wherein the shroud side (10) is flat and parallel to the target surface (6).

5. A gas turbine/turbo machine having the device according to claim 1.

* * * * *